US010553416B2

(12) United States Patent
Akutsu et al.

(10) Patent No.: US 10,553,416 B2
(45) Date of Patent: Feb. 4, 2020

(54) MASS SPECTROMETER PERFORMING MASS SPECTROMETRY FOR SAMPLE WITH LASER IRRADIATION

(71) Applicant: TOSHIBA MEMORY CORPORATION, Tokyo (JP)

(72) Inventors: Haruko Akutsu, Kanagawa (JP); Toma Yorisaki, Tokyo (JP)

(73) Assignee: Toshiba Memory Corproation, Tokyo (JP)

( * ) Notice: Subject to any disclaimer, the term of this patent is extended or adjusted under 35 U.S.C. 154(b) by 779 days.

(21) Appl. No.: 15/066,749

(22) Filed: Mar. 10, 2016

(65) Prior Publication Data

US 2017/0076930 A1 Mar. 16, 2017

(30) Foreign Application Priority Data

Sep. 11, 2015 (JP) ..... 2015-179921

(51) Int. Cl.
*H01J 49/16* (2006.01)
*H01J 49/40* (2006.01)

(52) U.S. Cl.
CPC ..... *H01J 49/162* (2013.01); *H01J 49/40* (2013.01)

(58) Field of Classification Search
CPC ..... H01J 49/162; H01J 49/0463; H01J 2237/31749; H01J 49/40
See application file for complete search history.

(56) References Cited

U.S. PATENT DOCUMENTS 4,421,721 A * 12/1983 Byer ..... C30B 15/00 117/202
5,105,082 A * 4/1992 Maruo ..... H01J 49/4215 250/287
6,137,110 A 10/2000 Pellin et al.
7,851,744 B2 * 12/2010 Brown ..... G02B 27/0927 250/281
9,299,552 B2 3/2016 Yorisaki
2010/0323917 A1 * 12/2010 Vertes ..... H01J 49/0418 506/12
2011/0224104 A1 * 9/2011 Razumovski ..... C12Q 1/04 506/26

FOREIGN PATENT DOCUMENTS

JP 6-310092 11/1994
JP H 07-65776 A 3/1995
JP 2000-162164 6/2000
JP 2006-78470 3/2006
JP 2008-525956 7/2008

* cited by examiner

*Primary Examiner* — Brooke Purinton
(74) *Attorney, Agent, or Firm* — Finnegan, Henderson, Farabow, Garrett & Dunner, L.L.P.

(57) ABSTRACT

A mass spectrometer includes a beam radiator radiating a beam to a sample. A laser radiator radiates laser light onto an irradiation surface of a surface of the sample irradiated with the beam or above the irradiation surface. The laser radiator splits the laser light into at least first light and second light. The laser radiator adjusts a polarization state, a length of an optical path, or a direction of the optical path of at least either the first light or the second light to condense the first light and the second light onto the irradiation surface or above the irradiation surface. A detector detects particles discharged from the sample.

12 Claims, 2 Drawing Sheets

MASS SPECTROMETER PERFORMING MASS SPECTROMETRY FOR SAMPLE WITH LASER IRRADIATION

CROSS REFERENCE TO RELATED APPLICATIONS

This application is based upon and claims the benefit of priority from the prior Japanese Patent Application No. 2015-479921, filed on Sep. 11, 2015, the entire contents of which are incorporated herein by reference.

FIELD

The embodiments of the present invention relate to a mass spectrometer.

BACKGROUND

A mass spectrometer such as an SNMS (Sputtered Neutral Mass Spectrometry) apparatus radiates a FIB (Focused Ion Beam) to a surface of a sample and radiates laser light to neutral particles generated by radiation of the FIB to ionize the neutral particles. The ionized particles fly within a reflectron and are detected by an MCP (Micro Channel Plate). Mass spectrometry for the sample is performed based on a TOF (Time Of Flight) of the particles in this flight.

When the laser light is radiated to the sample in this mass spectrometer, thermal expansion of the sample occurs, so that a position irradiated with the FIB is changed (drifted). Further, radiation of the laser light to the sample vaporizes impurities such as moisture adhering to the sample to cause removal of gas from the sample.

When the gas enters into the reflectron that is in a decompressed state, noises (background) increase to lower an SN (Signal/Noise) ratio. Therefore, the accuracy of particle detection is lowered.

DETAILED DESCRIPTION

A mass spectrometer includes a beam radiator radiating a beam to a sample. A laser radiator radiates laser light onto an irradiation surface of a surface of the sample irradiated with the beam or above the irradiation surface. The laser radiator splits the laser light into at least first light and second light. The laser radiator adjusts a polarization state, a length of an optical path, or a direction of the optical path of at least either the first light or the second light to condense the first light and the second light onto the irradiation surface or above the irradiation surface. A detector detects particles discharged from the sample.

Embodiments will now be explained with reference to the accompanying drawings. The present invention is not limited to the embodiments.

First Embodiment

Figure 1:
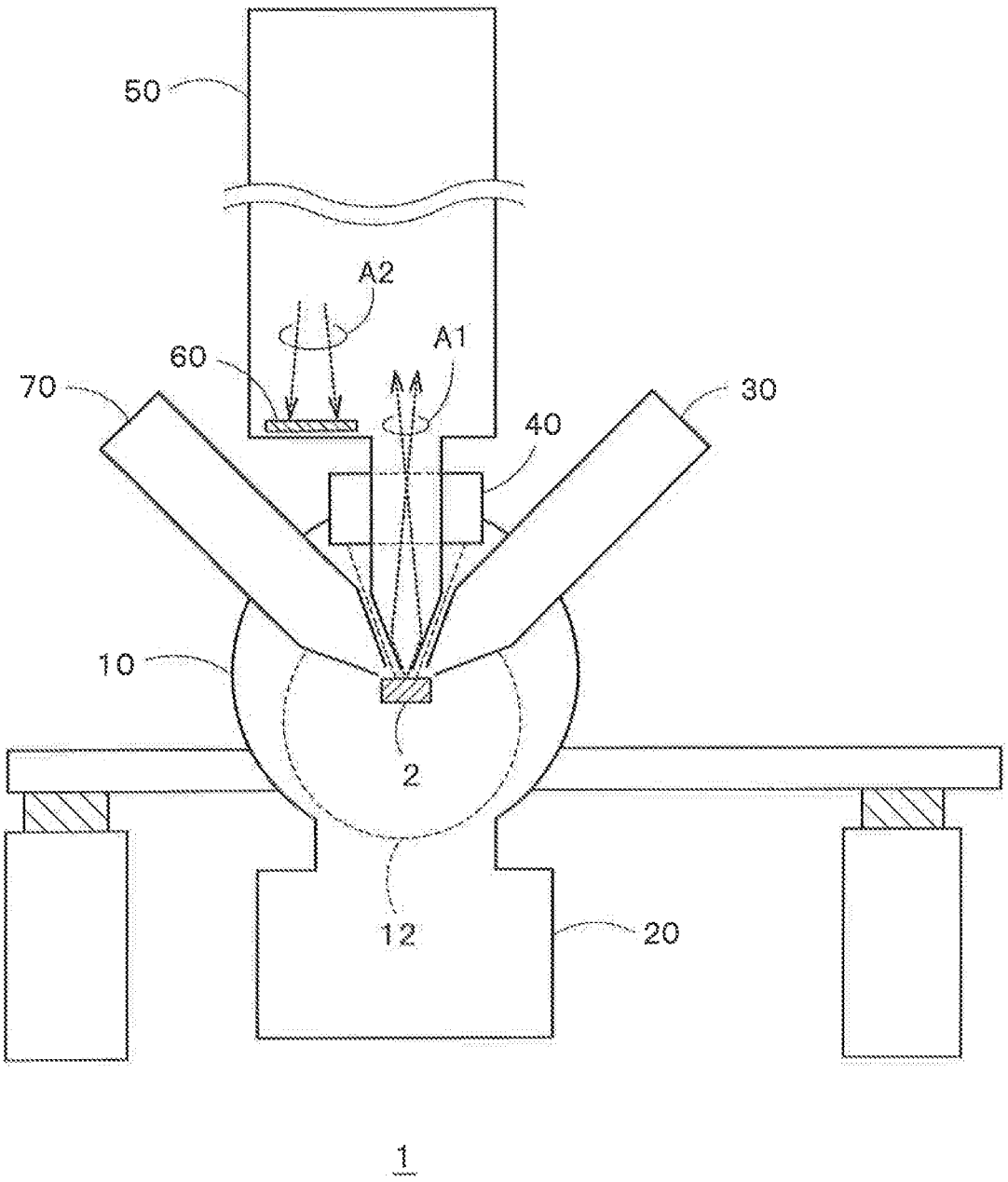
FIG. 1 shows a configuration example of a mass spectrometer 1 according to a first embodiment.

FIG. 1 shows a configuration example of a mass spectrometer 1 according to a first embodiment. The mass spectrometer 1 includes a chamber 10, a sample holder 12, a vacuum pump 20, a FIB radiating part (a FIB radiator) 30, a laser radiating part (a laser radiator) 40, a reflectron 50, an MCP 60, and a SEM (Scanning Electron Microscope) electron gun 70.

The chamber 10 can accommodate a sample 2 therein. The pressure in the chamber 10 is reduced by the vacuum pump 20. The sample 2 can be placed on the sampler holder 12.

The FIB radiating part 30 radiates an ion beam to the sample 2 placed on the sample holder 12. For example, the FIB radiating part 30 generates an ion beam from a source of primary ions, such as gallium, and pulses the generated ion beam with an electrostatic deflector and an aperture (both not shown). The FIB radiating part 30 then condenses the pulsed ion beam with an ion beam lens (not shown) and radiates the condensed beam to the sample 2. The radiation of the ion beam to the sample 2 causes neutral particles to be discharged (sputtered) from the sample 2. In the following descriptions, the ion beam is also referred to as "FIB".

The laser radiating part 40 generates infrared laser light, for example, and splits this laser light into plural rays of laser light. The laser radiating part 40 adjusts a polarization state, a length of an optical path, or a direction of the optical path of at least some of the split rays of laser light and then condenses the rays of laser light above the sample 2. In order to radiate the laser light to the neutral particles discharged from the sample 2, the laser radiating part 40 condenses or focuses the laser light immediately above an irradiation surface of the surface of the sample 2 irradiated with the ion beam or onto the irradiation surface. The laser radiating part 40 radiates the laser light above the sample 2 at a timing of discharge of the neutral particles from the sample 2. In this manner, the laser radiating part 40 can radiate the laser light to the neutral particles discharged from the sample 2. The neutral particles are ionized by being radiated with the laser light to turn into photoexcited ions (hereinafter, also simply "ions"). The configuration of the laser radiating part 40 is explained later with reference to FIG. 2.

The reflectron 50 as a particle controller includes an electrode plate and generates an electric field inside the reflectron 50 by applying a voltage to the electrode plate. The reflectron 50 directs the ions in a direction shown with arrows A1 by means of the electric field and causes the ions to circle around and fly to the MCP 60 as shown with arrows A2. That is, the reflectron 50 directs the particles that are discharged from the sample 2 by the ion beam and are ionized by the laser light to the MCP 60.

The MCP 60 as a detector detects the ions hitting a detection surface thereof. By this detection, the mass spectrometer 1 can measure a TOF that is a time from discharge of the neutral particles from the sample 2 to detection of the ions by the MCP 60. The TOF depends on the mass of the ions. Therefore, the mass of the ions is found by referring to the TOF. Based on the mass of the ions, a material (an element) of the neutral particles discharged from the sample 2 is found. In this manner, the mass spectrometer 1 can identify the material of the sample 2 by detecting the mass of the particles discharged from the sample 2.

The SEM electron gun 70 radiates an electron beam to the sample 2 in order to acquire an image of the surface of the sample 2.

Figure 2:
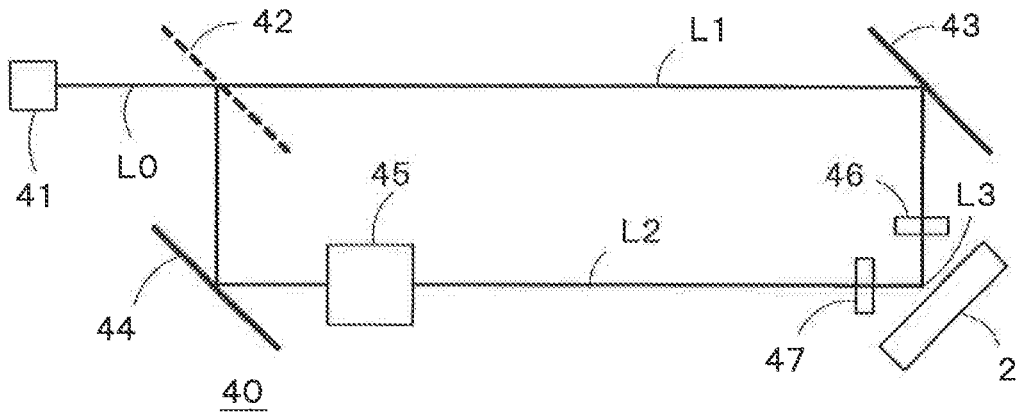
FIG. 2 shows a configuration example of the laser radiating part 40.

FIG. 2 shows a configuration example of the laser radiating part 40. The laser radiating part 40 includes a laser light source 41, a half mirror 42, mirrors 43 and 44, a birefringence modulator 45, and condenser lenses 46 and 47. The laser light source 41 can be provided outside the laser radiating part 40.

The laser light source 41 outputs infrared laser light L0, for example.

The half mirror 42 as a splitter splits (divides) the laser light L0 from the laser light source 41 into first light L1 and second light L2. The first light L1 travels straight in the same direction as the laser light L0. The second light L2 is reflected by the half mirror 42 to a different direction from the first light L1.

The mirror 43 is a total-reflection mirror, for example, and receives the first light L1 to reflect the first light L1 towards the sample 2. The mirror 44 is a total-reflection mirror, for example, and receives the second light L2 to reflect the second light L2 towards the birefringence modulator 45. Lengths of an optical path of the first light L1 and that of the second light L2 are substantially equal to each other or are different from each other by an integer multiple of the wavelength of the first light L1 and the second light L2. The difference in the length between the optical path of the first light L1 and that of the second light L2 is smaller than a coherence length.

The birefringence modulator 45 as a changer is provided in the optical path of the second light L2 and can receive the second light L2 to change a polarization state of the second light L2. The birefringence modulator 45 may be an element that changes a polarization direction of incident light, such as a Pockels cell or a Kerr cell. The birefringence modulator 45 can switch the polarization direction of the second light L2 between a direction (first direction) substantially parallel to a polarization direction of the first light L1 and a direction (second direction) substantially perpendicular to the polarization direction of the first light L1. The polarization direction is a direction of a magnetic field vector or an electric field vector in a polarization plane of light.

The condenser lens 46 as a condenser condenses the first light L1 from the mirror 43 in such a manner that the first light L1 is focused onto the irradiation surface of the surface of the sample 2 irradiated with the ion beam or above the irradiation surface. It suffices to cause the position of the focus to match a position of the neutral particles discharged from the sample 2.

The condenser lens 47 as a condenser condenses the second light L2 having passed through the birefringence modulator 45 in such a manner that the second light L2 is focused onto the irradiation surface of the surface of the sample 2 irradiated with the ion beam or above the irradiation surface. It suffices to cause the position of the focus to match the position of the neutral particles discharged from the sample 2. The position of the focus of the condenser lens 47 is substantially the same as that of the condenser lens 46.

Explanations are given to changing the polarization states of the first light L1 and the second light L2.

In a case where phases of the first light L1 and the second light L2 are equal to each other and the polarization direction of the second light L2 is substantially parallel to that of the first light L1, the first light L1 and the second light L2 interfere with each other when the first light L1 and the second light L2 are condensed to the same position. Therefore, by condensing the first light L1 and the second light L2 above the sample 2, the laser radiating part 40 can radiate laser light L3 having a high photon density to the neutral particles discharged from the sample 2. The laser light L3 is condensed or focused immediately above the irradiation surface of the surface of the sample 2 irradiated with the ion beam or onto the irradiation surface for achieving radiation of laser light to the neutral particles. That is, the laser light L3 is radiated towards the same surface as the irradiation surface irradiated with the ion beam and is condensed to form a focus immediately above the irradiation surface. In this manner, the laser light L3 can ionize the neutral particles discharged from the sample 2.

On the other hand, in a case were the polarization direction of the second light L2 is substantially perpendicular to that of the first light L1 even when the phases of the first light L1 and the second light L2 are equal to each other, the first light L1 and the second light L2 hardly interfere with each other when the first light L1 and the second light L2 are condensed to the same position. Therefore, the photon density of the laser light L3 is small even when the first light L1 and the second light L2 are condensed above the sample 2. Accordingly, while the sample 2 is heated to some extent, removal of gas from the sample 2 can be suppressed. The photon density is the number of photons radiated to a unit area per unit time (a photon flux density) and is different from the intensity or energy of light. Therefore, while not changed in the intensity or energy due to switching by the birefringence modulator 45, the laser light L3 is changed in the photon density.

In this manner, the birefringence modulator 45 can switch the photon density of the laser light L3 obtained by condensing the first light L1 and the second light L2 due to switching of the polarization direction of the second light L2 between the direction substantially parallel to the polarization direction of the first light L1 and the direction substantially perpendicular to that of the first light L1.

As described above, the laser radiating part 40 according to the first embodiment splits the laser light L0 into the first light L1 and the second light L2, and adjusts the polarization state of the second light L2 to condense the second light L2 and the first light L1 above the sample 2. In this operation, the laser radiating part 40 performs switching between a state where the polarization direction of the first light L1 and that of the second light L2 are substantially parallel to each other and a state where they are substantially perpendicular to each other. By this switching, the photon density of the laser light L3 obtained by condensing the first light L1 and the second light L2 can be switched.

In a case where the polarization direction of the first light L1 and that of the second light L2 are substantially parallel to each other, the first light L1 and the second light L2 interfere with each other to increase the photon density of the laser light L3. Therefore, when the polarization directions of the first light L1 and the second light L2 are cause to be substantially parallel to each other during an ion measurement, the laser light L3 can ionize the neutral particles discharged from the sample 2. On the other hand, in a case where the polarization direction of the first light L1 and that of the second light L2 are substantially perpendicular to each other, the first light L1 and the second light L2 hardly interfere with each other and the photon density of the laser light L3 is small. Therefore, when the polarization directions of the first light L1 and the second light L2 are caused to be substantially perpendicular to each other in a standby state (a state where no ion measurement is performed), removal of gas from the sample 2 can be suppressed although the sample 2 is heated to some extent. Consequently, the accuracy of ion detection is improved, so that accurate mass spectrometry can be achieved. During the measurement, removal of gas from the sample 2 also occurs to some extent because the photon density of the laser light L3 is large. However, because the removal of gas is suppressed in the standby state, noises are reduced by an amount corresponding to suppression in the removal of gas, and the accuracy of ion detection is improved.

The mass spectrometer 1 according to the first embodiment switches the polarization direction of the second light L2 between in the standby state and in the measurement while continuously radiating the laser light L3 to the sample 2. That is, the laser light L3 is continuously radiated to the sample 2 not only in the measurement but also in the standby state. Therefore, the sample 2 is heated to some extent not only in the measurement but also in the standby state, and a difference between the temperature of the sample 2 in the measurement and that in the standby state is suppressed. Consequently, a difference in thermal expansion of the sample 2 is reduced, so that a change (drift) of the measurement position of the sample 2 is suppressed.

If the laser radiating part 40 radiates the laser light L3 to the sample 2 only in the ion measurement and stops radiation of the laser light L3 in the standby state, the difference between the temperature of the sample 2 in the measurement and that in the standby state becomes large. In this case, the drift of the sample 2 becomes large, lowering measurement accuracy.

On the other hand, the mass spectrometer 1 according to the first embodiment can suppress the difference between the temperature of the sample 2 in the measurement and that in the standby state to suppress the drift of the sample 2. Therefore, the mass spectrometer 1 can suppress the drift of the sample 2 while suppressing removal of gas from the sample 2 as much as possible. Due to this suppression, deterioration in the accuracy of mass spectrometry can be suppressed.

Second Embodiment

Figure 3:
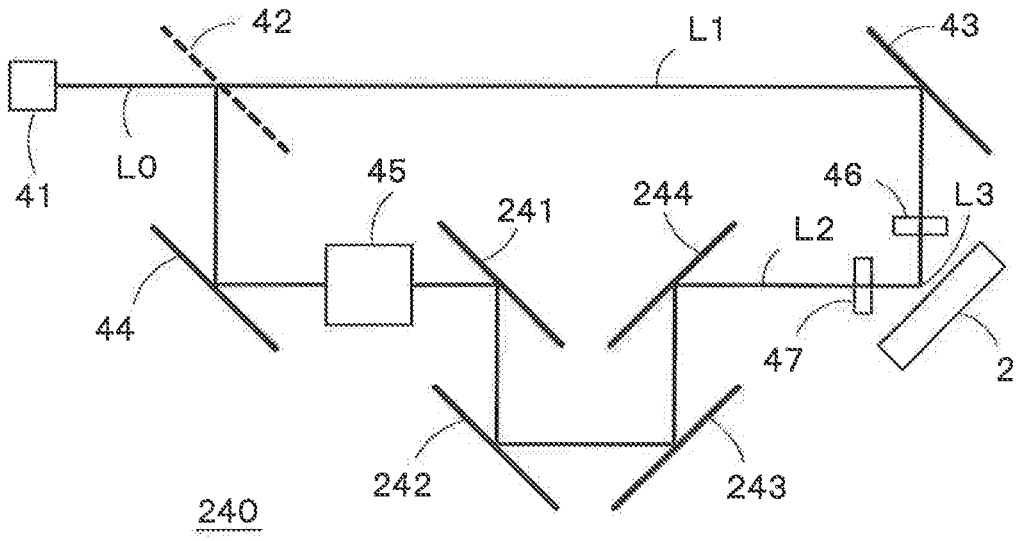
FIG. 3 shows a configuration example of a laser radiating part 240 according to a second embodiment.

FIG. 3 shows a configuration example of a laser radiating part 240 according to a second embodiment. The laser radiating part 240 according to the second embodiment is different from that according to the first embodiment in the optical path of the second light L2. The laser radiating part 240 further includes optical-path adjusting mirrors 241 to 244 that change the optical path of the second light L2. The optical-path adjusting mirrors 241 to 244 are total-reflection mirrors, for example, and are provided to adjust (change) the length of the optical path of the second light L2. With these mirrors, the length of the optical path of the second light L2 is caused to be different from the length of the optical path of the first light L1. In the second embodiment, the optical-path adjusting mirrors 241 to 244 cause the length of the optical path of the second light L2 to be longer than that of the first light L1. Other configurations of the second embodiment can be identical to the corresponding configurations of the first embodiment.

Further, the birefringence modulator 45 is provided in the optical path of the second light L2. The birefringence modulator 45 can not only change the polarization state of light but also can change the length of an optical path to some extent by applying a magnetic field or an electric field. Therefore, the laser radiating part 240 causes the length of the optical path of the first light L1 and that of the second light L2 to be different from each other by using the optical-path adjusting mirrors 241 to 244 and further adjusts the length of the optical path of the second light L2 with the birefringence modulator 45, thereby enabling to switch the difference between the length of the optical path of the first light L1 and that of the second light L2 between a value smaller than the coherence length and a value equal to or larger than the coherence length.

In a case where the difference between the length of the optical path of the first light L1 and that of the second light L2 is smaller than the coherence length, the first light L1 and the second light L2 interfere with each other when the first light L1 and the second light L2 are condensed to the same position. On the other hand, in a case where the difference between the length of the optical path of the first light L1 and that of the second light L2 is equal to or larger than the coherence length, the first light L1 and the second light L2 hardly interfere with each other even when the first light L1 and the second light L2 are condensed to the same position.

Therefore, during an ion measurement, the laser radiating part 240 adjusts the difference between the length of the optical path of the first light L1 and that of the second light L2 to be smaller than the coherence length to cause interference between the first light L1 and the second light L2. Due to this, the laser light L3 can ionize the neutral particles discharged from the sample 2. Meanwhile, in a standby state, the laser radiating part 240 adjusts the difference between the length of the optical path of the first light L1 and that of the second light L2 to be equal to or larger than the coherence length to cause almost no interference between the first light L1 and the second light L2. Therefore, the laser light L3 can suppress removal of gas from the sample 2 while heating the sample 2 to some extent. Therefore, the second embodiment can achieve effects identical to those of the first embodiment.

Third Embodiment

Figure 4:
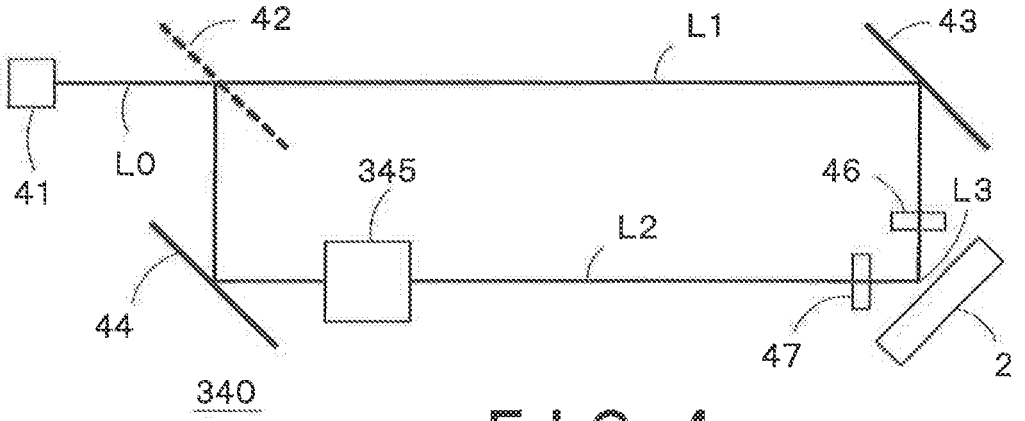
FIG. 4 shows a configuration example of a laser radiating part 340 according to a third embodiment.

FIG. 4 shows a configuration example of a laser radiating part 340 according to a third embodiment. The laser radiating part 340 according to the third embodiment is different from that according to the first embodiment in that the laser radiating part 340 includes an acoustic cell 345 as a changing part. Other configurations of the third embodiment can be identical to the corresponding configurations of the first embodiment.

The acoustic cell 345 adjusts (changes) the direction of the optical path of the second light L2 with acoustic phonons. By performing this adjustment, the acoustic cell 345 can adjust the position of the focus of the second light L2 condensed by the lens 47 to match the position of the focus of first light L1 condensed by the lens 43 or to be deviated therefrom.

In a case where the position of the focus of the second light L2 matches that of the first light L1, the first light L1 and the second light L2 are condensed to the same position and interfere with each other. Meanwhile, in a case where the position of the focus of the second light L2 is deviated from that of the first light L1, the first light L1 and the second light L2 are not condensed to the same position. Therefore, the first light L1 and the second light L2 hardly interfere with each other.

For this reason, during an ion measurement, the laser radiating part 340 adjusts the position of the focus of the second light L2 to match the position of the focus of the first light L1, thereby causing the first light L1 and the second light L2 to interfere with each other. This operation enables the laser light L3 to ionize the neutral particles discharged from the sample 2.

Meanwhile, in a standby mode, the laser radiating part 340 deviates the position of the focus of the second light L2 from the position of the focus of the first light L1 to cause almost no interference between the first light L1 and the second light L2. The laser light L3 can thus suppress removal of gas from the sample 2 while heating the sample 2 to some extent. Therefore, the third embodiment can also achieve effects identical to those of the first embodiment. The third embodiment can be combined with the second embodiment.

In the first to third embodiments, the mass spectrometer 1 changes the polarization state, the length of the optical path, or the direction of the optical path of the second light L2. However, the mass spectrometer 1 may change the polarization state, the length of the optical path, or the direction of the optical path of the first light L1. In this case, the birefringence modulator 45, the optical-path adjusting mirrors 241 to 244, or the acoustic cell 345 is/are provided in the optical path of the first light L1. Alternatively, the mass spectrometer 1 may change the polarization states, the lengths of the optical paths, or the directions of the optical paths of both the first light L1 and the second light L2. In this case, the birefringence modulator 45, the optical-path adjusting mirrors 241 to 244, or the acoustic cell 345 is/are provided in each of the optical paths of the first light L1 and the second light L2.

While the laser light L0 is split into the first light L1 and the second light L2, the laser light L0 can be split into three or more rays of light. In this case, the laser radiating part 40 can adjust a polarization state, a length of an optical path, or a direction of the optical path of at least one of first to third rays of light to condense the first to third rays of light above the sample 2.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

The invention claimed is:

1. A mass spectrometer comprising:

a beam radiator radiating a beam to a sample;

a laser radiator radiating laser light onto an irradiation surface of a surface of the sample irradiated with the beam or above the irradiation surface, the laser radiator splitting the laser light into at least first light and second light and adjusting a polarization state, a length of an optical path, or a direction of the optical path of at least either the first light or the second light to condense the first light and the second light onto the irradiation surface or above the irradiation surface; and a detector detecting particles discharged from the sample, wherein:

the laser radiator is capable of switching a difference between a length of an optical path of the first light and that of the second light being condensed by a condenser lens on a same position as the first light, between a value smaller than a coherence length and a value equal to or larger than the coherence length, at least a part of the first light in the first condition and at least a part of the second light in the first condition are condensed to a same position, the first light in the first condition and the first light in the second condition are condensed to a same position, and the second light in the first condition and the second light in the second condition are condensed to a same position.

2. The mass spectrometer of claim 1, wherein the laser radiator includes a splitter splitting the laser light into the first light and the second light, a changer provided in the optical path of the first light or the second light to be capable of changing the polarization state, the length of the optical path, or the direction of the optical path of the at least either the first light or the second light, and the condenser lens condensing one of the first light and the second light and the other of the first light and the second light having passed through the changer onto the irradiation surface or above the irradiation surface.

3. The mass spectrometer of claim 2, wherein the changer is a birefringence modulator.

4. The mass spectrometer of claim 2, wherein the laser radiator includes optical-path adjusting mirrors lengthening the optical path of the first light or the second light.

5. The mass spectrometer of claim 2, wherein the changer is an acoustic cell.

6. The mass spectrometer of claim 2, wherein the splitter is a half mirror.

7. The mass spectrometer of claim 3, wherein the splitter is a half mirror.

8. The mass spectrometer of claim 1, further comprising a particle controller directing particles to the detector, the particles being discharged from the sample by the beam and being ionized by the laser light.

9. The mass spectrometer of claim 2, further comprising a particle controller directing particles to the detector, the particles being discharged from the sample by the beam and being ionized by the laser light.

10. The mass spectrometer of claim 3, further comprising a particle controller directing particles to the detector, the particles being discharged from the sample by the beam and being ionized by the laser light.

11. The mass spectrometer of claim 1, wherein the laser light is infrared laser light.

12. The mass spectrometer of claim 1, wherein the laser radiator is capable of switching a difference between a polarization direction of the first light and that of the second light, between a first condition and a second condition, the second condition being different from the first condition in the difference of the polarization direction.

* * * * *